US012228331B1

(12) United States Patent
Emmert

(10) Patent No.: US 12,228,331 B1
(45) Date of Patent: Feb. 18, 2025

(54) EGG STORAGE AND DISPENSING SYSTEM

(71) Applicant: Eric Wayne Emmert, Phoenix, AZ (US)

(72) Inventor: Eric Wayne Emmert, Phoenix, AZ (US)

( * ) Notice: Subject to any disclaimer, the term of this patent is extended or adjusted under 35 U.S.C. 154(b) by 0 days.

(21) Appl. No.: 18/910,512

(22) Filed: Oct. 9, 2024

(51) Int. Cl.
*F25D 25/00* (2006.01)

(52) U.S. Cl.
CPC ..... *F25D 25/00* (2013.01); *F25D 2331/807* (2013.01)

(58) Field of Classification Search
CPC .. F25D 2331/807; F25D 25/022; F25D 25/00; F25D 25/02; F25D 25/021; F25D 25/04; F25D 2331/809; A47F 3/0486
See application file for complete search history.

(56) References Cited

U.S. PATENT DOCUMENTS 2,188,044 A 8/1936 Hickman
2,138,418 A 11/1938 Fahrne
2,149,821 A 3/1939 Sutherland
2,588,618 A * 3/1952 Di Renzo ..... F25D 25/00 312/49
2,823,972 A * 2/1958 Saunders ..... F25D 23/04 312/328
3,501,016 A * 3/1970 Eaton ..... A47F 7/28 211/49.1
4,528,825 A * 7/1985 Khan ..... F25D 25/02 312/313
2005/0183637 A1* 8/2005 Reeser ..... A47B 88/407 108/26
2020/0022507 A1* 1/2020 De Sanctis ..... A47F 7/28

FOREIGN PATENT DOCUMENTS

DE 20317109 U1 * 2/2004 ..... F25D 25/00
KR 20060071642 A * 6/2006
WO WO-2005057109 A1 * 6/2005 ..... F25D 25/02
WO WO-2016000736 A1 * 1/2016 ..... F25D 23/04
WO WO-2019186646 A1 * 10/2019

* cited by examiner

*Primary Examiner* — Hiwot E Tefera
(74) *Attorney, Agent, or Firm* — Plager Schack LLP; Mark H. Plager, Esq.; Naomi Mann, Esq.

(57) ABSTRACT

An egg storage and dispensing device and system provides a dispenser basket for holding eggs in a conveniently accessible position. The dispenser basket is further configured to suspend from a refrigerator shelf via suction cup pressure, for space saving.

9 Claims, 4 Drawing Sheets

EGG STORAGE AND DISPENSING SYSTEM

BACKGROUND

The present disclosure relates generally to space saving systems for refrigerators and more particularly to an egg storage and dispensing system for conserving space within a refrigerator and for holding eggs in a conveniently accessible position.

SUMMARY

According to various embodiments, disclosed is an egg storage and dispensing system, which may comprise a dispenser basket configured to securely hold a plurality of eggs, the dispenser basket including a top opening delineated by a top edge; and suspension elements coupled to the dispenser basket which are configured to suspend the dispenser basket from a refrigerator shelf via suction pressure to a bottom surface of the refrigerator shelf. In certain embodiments, the suspension elements comprise a pair of rear legs including bottom ends configured to couple to a rear section of the dispenser basket, and a pair of front legs including bottom ends configured to couple to a front section of the dispenser basket, wherein each of the legs extend upwards over the top edge of the dispenser basket, wherein each leg of the rear legs and front legs include a top end configured to couple to a suction cup, the suction cups being configured to attach to the bottom surface of the refrigerator shelf via suction pressure.

In some embodiments, the dispenser basket comprises a first side channel, a second side channel congruent to and formed adjacent to the first side channel, and a front channel, the first side channel and the second side channel providing elongated side-by-side compartments which are separated from one another. In some embodiments, the first side channel and the second side channel each have a U shaped cross section which provides a concaved bottom wall that provides an egg support surface in each channel. In certain embodiments, the front channel continuously extends frontwards from adjacent front ends of the first side channel and the second side channel, the front channel forming a connective pathway between the first side channel and the second side channel and having a concaved bottom wall, similar to the bottom wall of the first and second side channels, to provide an egg support surface in the front channel.

In some embodiments, each of the first side channel ad the second side channel has a width that accommodates a single medium to large egg oriented with the egg's major axis aligned along the width of the respective side channel, allowing the egg to naturally roll along a length of the channel. In some embodiments, the rear legs are shorter than the front legs to enable dispenser basket to suspend at a downwards slope when suspended in a front facing position from the refrigerator shelf, the downwards slope causing an egg in the first and/or second side channels to roll towards the front channel under gravitational force. In certain embodiments, the front channel has a rounded front wall that provides a front side enclosure of the dispenser basket. In some embodiments, the dispenser basket includes a planar back wall that provides a rear enclosure for the first side channel and the second side channel. In some embodiments, the fill capacity of dispenser basket is from about 10 to about 15 eggs. In some embodiments, the dispenser basket includes a pair of rear leg slots configured to receive the rear legs and to lockably engage with the bottom ends of the rear legs, and a pair of front leg slots configured to receive the front legs and to lockably engage with the bottom ends of the front legs. In some embodiments, a top end of each of the rear legs and front legs includes a cup slot configured for releasable engagement with a bottom connection end of the suction cup.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

According to various embodiments as depicted in FIGS. 1-6, disclosed is an egg storage and dispensing device and system 10 which comprises a dispenser basket 12 for securely holding eggs 36. In embodiments, dispenser basket 12 includes a top opening delineated by a top edge 12B to allow for placement and removal of eggs 36 from the basket. Dispenser basket 12 is further configured to suspend from a refrigerator shelf 34 for space saving.

Figure 1:
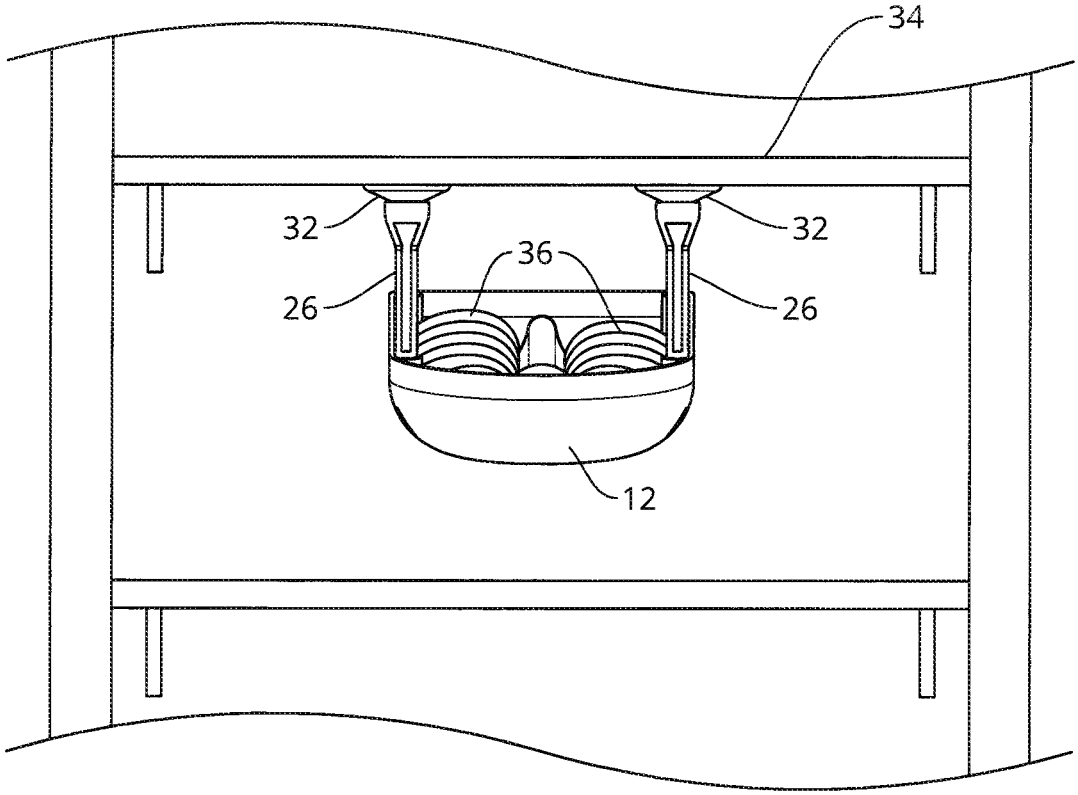
FIG. 1 is a front view of egg storage and dispensing device, shown in use.
Figure 2:
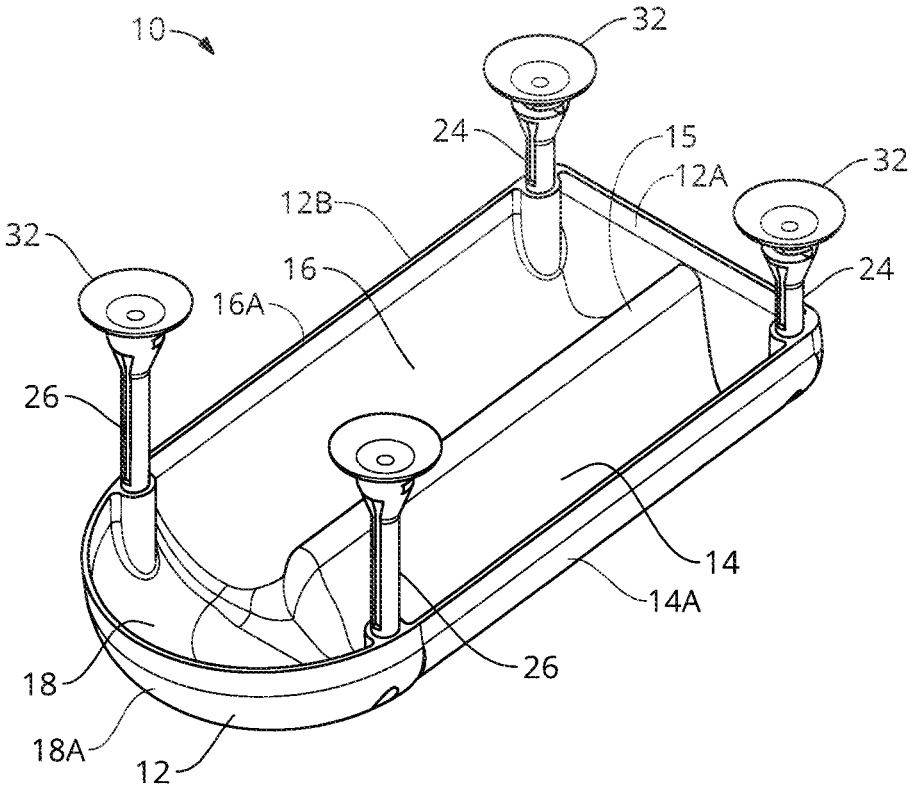
FIG. 2 is a perspective view of the device of FIG. 1.
Figure 3:
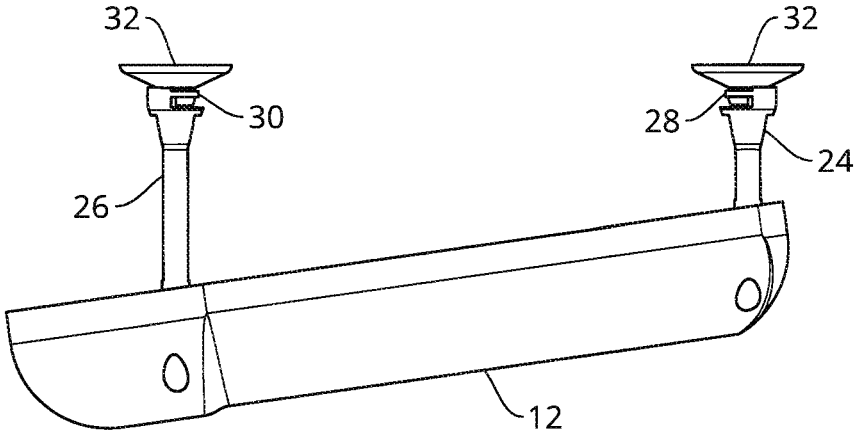
FIG. 3 is a side view thereof.
Figure 4:
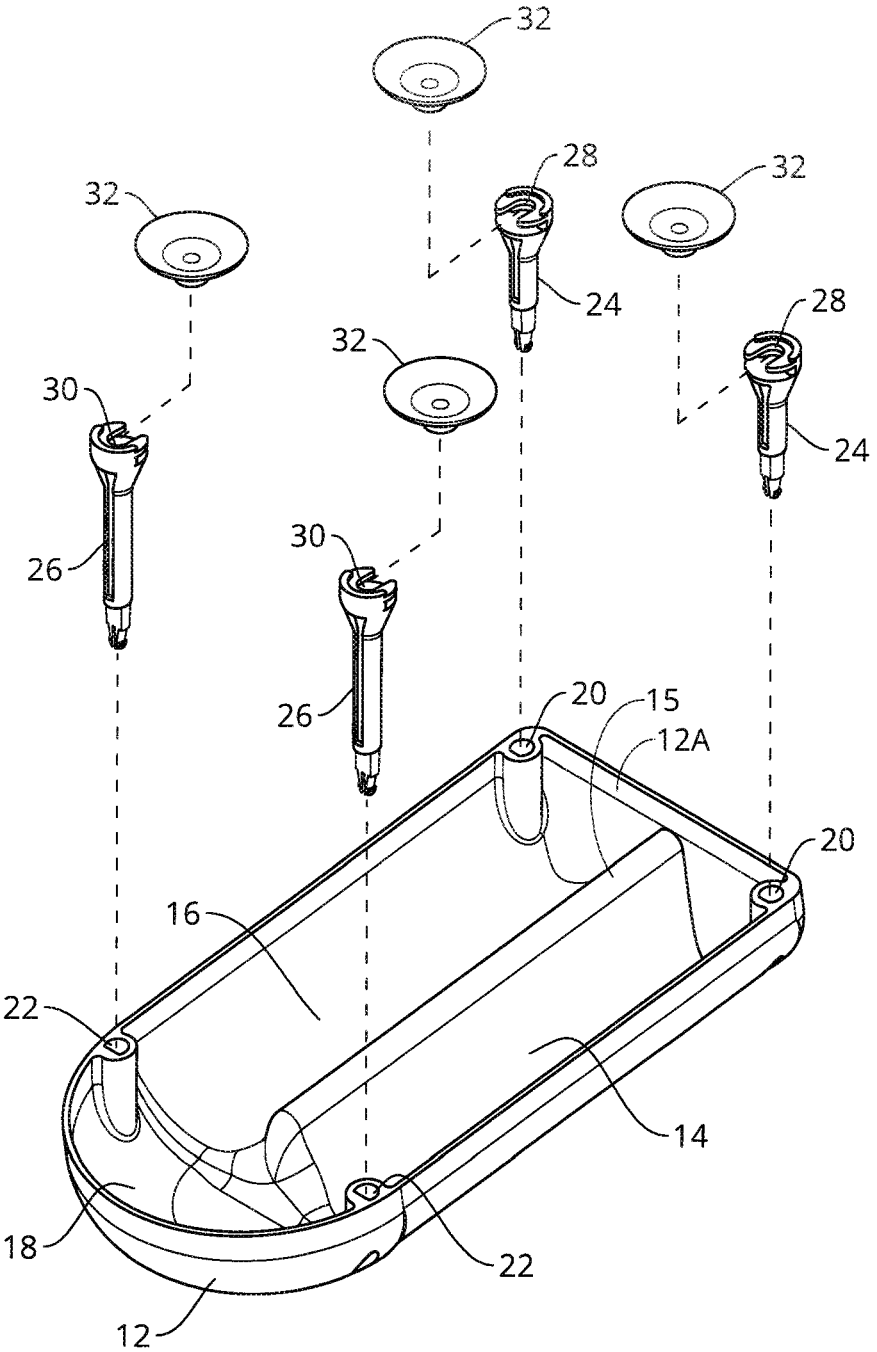
FIG. 4 is an exploded view thereof.
Figure 5:
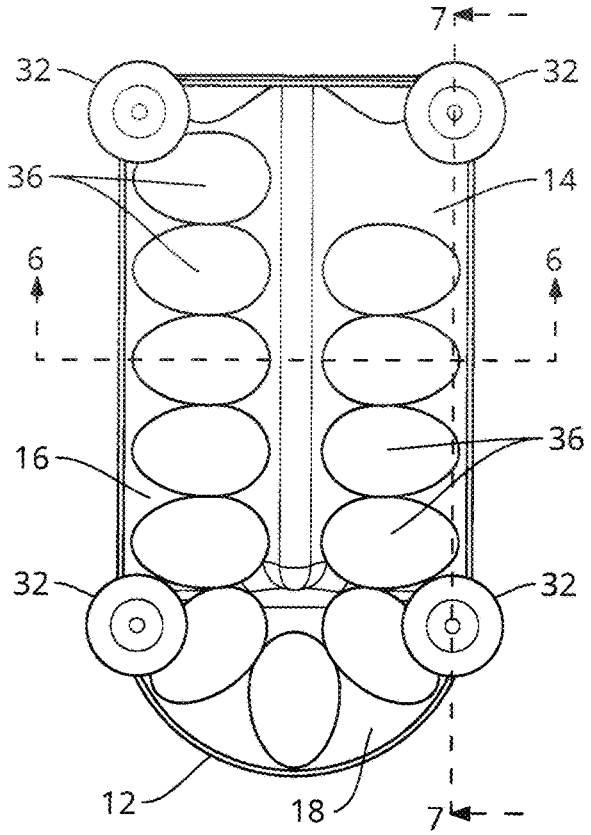
FIG. 5 is a top view of the device with eggs in place.
Figure 6:
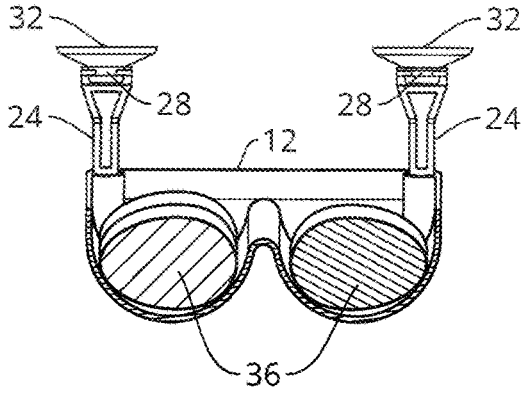
FIG. 6 is a section view taken along line 6-6 in FIG. 5.
Figure 7:
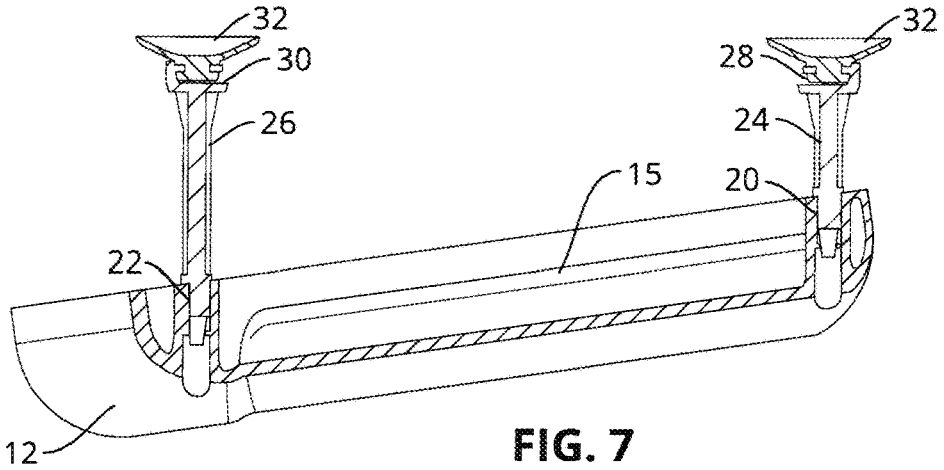
FIG. 7 is a section view taken along line 7-7 in FIG. 5 with the eggs removed for clarity.

In certain embodiments, dispenser basket 12 may comprise a first side channel 14, a second side channel 16 formed adjacent to first side channel 14, and a front channel 18. In some embodiments as depicted in the figures, first side channel 14 and second side channel 16 provide elongated and congruent side-by-side compartments with a common top central edge 15. In some embodiments, side channels 14, 16, have a concaved and/or parabolic bottom wall. In one embodiment, side channels 14, 16 may have an approximate "U" shaped cross section that provides an egg support surface in each channel, and further forms the outer side walls 14A, 16A, of the channels and/or dispenser basket 12. The "U" and/or concave shape further mimics the shape of a common chicken egg, thus providing a cradling support surface for eggs 36. In further embodiments, each of side channels 14, 16 has a width that may accommodate a single egg (i.e., a medium to large chicken egg) oriented with the egg's major axis along the width of the respective channel as shown in FIG. 5. This allows the eggs to naturally roll along the length of the channels. In certain embodiments, a back wall 12A of dispenser basket 12 provides a generally planar rear enclosure for the side channels 14, 16, and/or dispenser basket 12.

In certain embodiments, front channel 18 continuously extends frontwards from adjacent front ends of side channels 14 and 16, and has a rounded front wall 18A that provides a front side enclosure of channel 18 and/or dispenser basket 12. Front channel 18 further forms a connective pathway between the side channels with a similarly concaved bottom wall to likewise provide a cradling support surface for eggs 36 and allow the eggs to naturally roll along the channel. Thus, one or more eggs 36 in dispenser basket 12 may fluidly roll amongst channels 14, 14, and 18, when basket is less than full. In some embodiments, the fill capacity of dispenser basket 12 may be from about 10 to about 15 medium eggs, or about 13 medium eggs, but is not limited to this option.

In certain embodiments, egg storage and dispensing system 10 further comprises suspension elements coupled to dispenser basket 12, which are configured to attach to a refrigerator shelf 34 for suspending dispenser basket 12 below the shelf. In some embodiments, the suspension elements may comprise elongated members or "legs" that may attach to a bottom surface or underside of shelf 34 via suction cups 34. In one embodiment, the suspension elements include a pair of rear legs 24 attached at opposite sides at a rear section of dispenser basket 12, and a pair of front legs 26 attached at opposite sides at a front section of dispenser basket 12. In some embodiments, rear legs 24 and front legs 26 may each include a bottom male connector configured to lockably engage a female connector within a leg receiving slot in dispenser basket 12. In one embodiment, dispenser basket 12 may include a pair of rear leg slots 20 for lockable engagement with rear legs 24, and a pair of front leg slots 22 for lockable engagement with front legs 26. As such, legs 24, 26 are fixed within slots 20, 22, and extend upwards from top edge 12B of dispenser basket 12. In further embodiments, a suction cup 32 is coupled to a top end of each of rear legs 24 and front legs 26. In one embodiment, cup slots 28 and 30 may be provided in rear and front legs 24, 26, respectively, for releasable engagement with bottom connection ends in the suction cups. Cup slots 28, 30 provide a secure connection while enabling the basket and legs to be detached and/or disassembled (e.g., for cleaning or refilling). It shall be appreciated that different attachment mechanisms for coupling legs 24, 26 to dispenser basket 12 and/or to suction cups 32 may be used in alternate embodiments. It shall be appreciated that a different number of legs may be used in alternate embodiments. It shall be appreciated that a different number of side channels may be used in alternate embodiments.

In certain embodiments, rear legs 24 may be shorter than front legs 26 to enable dispenser basket 12 to hang at downwards slop from refrigerator shelf 34 when attached in a front facing orientation, such that front channel 18 hangs lower than back wall 12A. As such, dispenser basket 12 may be attached underneath refrigerator shelf 34 via suction cups 32, with front channel 18 facing toward the front to provide an egg dispensing trough in dispenser basket 12. The sloped orientation forces eggs 36 in dispenser basket 12 to roll downwards via gravity and fill front channel 18, for convenient access.

The disclosed system thus provides an egg dispenser which hangs from a refrigerator shelf to save space, and is further sloped downwards so that eggs roll into the front channel of the basket. It shall be appreciated that the disclosed system may have different configurations in alternate embodiments. For example, different suspension components, such as brackets and the like, may be used to hang the dispenser basket from the shelf in alternate embodiments. In some alternate embodiments, a leg or bracket may be attached to a side wall of the refrigerator to hold the dispenser basket in suspension. Additionally, the disclosed system may be used to dispense other objects, and/or adapted to other applications in alternate embodiments.

According to an exemplary embodiment, components of the disclosed system 10 may be made of a plastic material. According to an exemplary embodiment, egg basket 12 may be configured to slope approximately 5 to 10 degrees, or about 8 degrees when suspended. Egg basket 12 may have an internal width of about 5 inches, and a length of about 12 inches. It shall be appreciated that components of system 10 may comprise any alternative known materials in the field and be of any size and/or dimensions. It shall be appreciated that the components of system 10 may be manufactured and assembled using any known techniques in the field.

It shall be understood that the orientation or positional relationship indicated by terms such as "upper", "lower", "front", "rear", "left", "right", "top", "bottom", "inside", "outside" is based on the orientation or positional relationship shown in the accompanying drawings, which is only for convenience and simplification of describing the disclosed subject matter, rather than indicating or implying that the indicated device or element must have a specific orientation or are constructed and operated in a specific orientation, and therefore should not be construed as a limitation of the present invention.

As used herein, the articles "a" and "an" are intended to include one or more items, and may be used interchangeably with "one or more." Where only one item is intended, the term "one" or similar language is used. Also, as used herein, the terms "has", "have", "having", "with" or the like are intended to be open-ended terms. Further, the phrase "based on" is intended to mean "based, at least in part, on" unless explicitly stated otherwise.

The constituent elements of the disclosed device and system listed herein are intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device. Terms such as 'approximate,' 'approximately,' 'about,' etc., as used herein indicate a deviation of within +/−10%. Relationships between the various elements of the disclosed device as described herein are presented as illustrative examples only, and not intended to limit the scope or nature of the relationships between the various elements. Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. An egg storage and dispensing system, comprising:

a dispenser basket configured to securely hold a plurality of eggs, the dispenser basket including a top opening delineated by a top edge;

suspension elements coupled to the dispenser basket which are configured to suspend the dispenser basket from a refrigerator shelf via suction pressure to a bottom surface of the refrigerator shelf, the suspension elements comprising a pair of rear legs including bottom ends configured to couple to a rear section of the dispenser basket, and a pair of front legs including bottom ends configured to couple to a front section of the dispenser basket, wherein each of the legs extend upwards over the top edge of the dispenser basket, and wherein each leg of the rear legs and front legs include a top end configured to couple to a suction cup, the suction cups configured to attach to the bottom surface of the refrigerator shelf via suction pressure; wherein the dispenser basket comprises a first side channel, a second side channel congruent to and formed adjacent to the first side channel, and a front channel, the first side channel and the second side channel providing elongated side-by-side compartments which are separated from one another, wherein the first side channel and the second side channel each have a U shaped cross section, which provides a concaved bottom wall that provides an egg support surface in each channel, wherein the front channel continuously extends frontwards from adjacent front ends of the first side channel and the second side channel, the front channel forming a connective pathway between the first side channel and the second side channel and having a concaved bottom wall, similar to the bottom wall of the first and second side channels, to provide an egg support surface in the front channel.

2. The egg storage and dispensing system of claim 1, wherein each of the first side channel ad the second side channel has a width that accommodates a single medium to large egg oriented with the egg's major axis aligned along the width of the respective side channel, allowing the egg to naturally roll along a length of the channel.

3. The egg storage and dispensing system of claim 2, wherein the rear legs are shorter than the front legs to enable dispenser basket to suspend at a downwards slope when suspended in a front facing position from the refrigerator shelf, the downwards slope causing an egg in the first and/or second side channels to roll towards the front channel under gravitational force.

4. The egg storage and dispensing system of claim 3, wherein the front channel has a rounded front wall that provides a front side enclosure of the dispenser basket.

5. The egg storage and dispensing system of claim 1, the dispenser basket including a planar back wall that provides a rear enclosure for the first side channel and the second side channel.

6. The egg storage and dispensing system of claim 1, wherein the fill capacity of the dispenser basket is from about 10 to about 15 eggs.

7. The egg storage and dispensing system of claim 1, wherein the rear legs are shorter than the front legs to enable dispenser basket to suspend at a downwards slope when suspended in a front facing position from the refrigerator shelf.

8. The egg storage and dispensing system of claim 1, wherein the dispenser basket includes a pair of rear leg slots configured to receive the rear legs and to lockably engage with the bottom ends of the rear legs, and a pair of front leg slots configured to receive the front legs and to lockably engage with the bottom ends of the front legs.

9. The egg storage and dispensing system of claim 1, wherein a top end of each of the rear legs and front legs includes a cup slot configured for releasable engagement with a bottom connection end of the suction cup.

* * * * *